United States Patent [19]

Nijman

[11] 4,106,024

[45] Aug. 8, 1978

[54] ANTENNA MOUNTING BASE

[75] Inventor: John Peter Nijman, West Hill, Canada

[73] Assignee: Bunker Ramo Corporation, Oak Brook, Ill.

[21] Appl. No.: 781,737

[22] Filed: Mar. 28, 1977

[51] Int. Cl.[2] ..... H01Q 1/32; H01Q 1/50

[52] U.S. Cl. ..... 343/715; 343/888; 343/900; 343/906

[58] Field of Search ..... 343/711–715, 343/900, 887–889, 892, 906; 174/153 A, 158 R

[56] References Cited

U.S. PATENT DOCUMENTS 3,444,313 5/1969 Goodchild et al. ..... 343/715

*Primary Examiner*—Alfred E. Smith
*Assistant Examiner*—David K. Moore
*Attorney, Agent, or Firm*—William Lohff; F. M. Arbuckle

[57] ABSTRACT

A support structure is disclosed for mounting a mobile antenna to a support plate and for connecting the antenna to a coaxial cable. The structure includes an electrically conductive nut adapted for mounting on the support plate, a dielectric cap to receive and house the nut and clamping means disposed between the nut and cap. The nut, cap and clamping means each has a central bore or passage to accommodate the cable. The clamping means is also constructed such that its frictional engagement with the cap is less than its frictional engagement with the nut, such that as the cap is threaded over the clamping means and nut, the clamping means remains generally stationary relative to the nut.

12 Claims, 5 Drawing Figures

FIG. 1
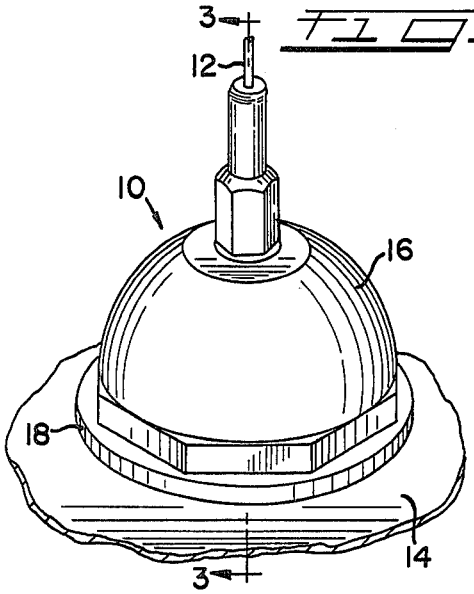
FIG. 2
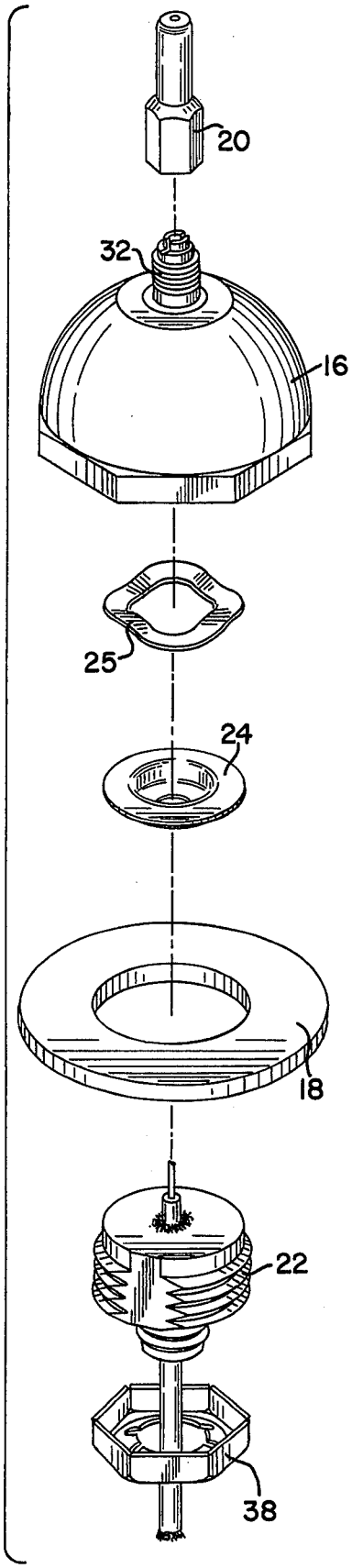
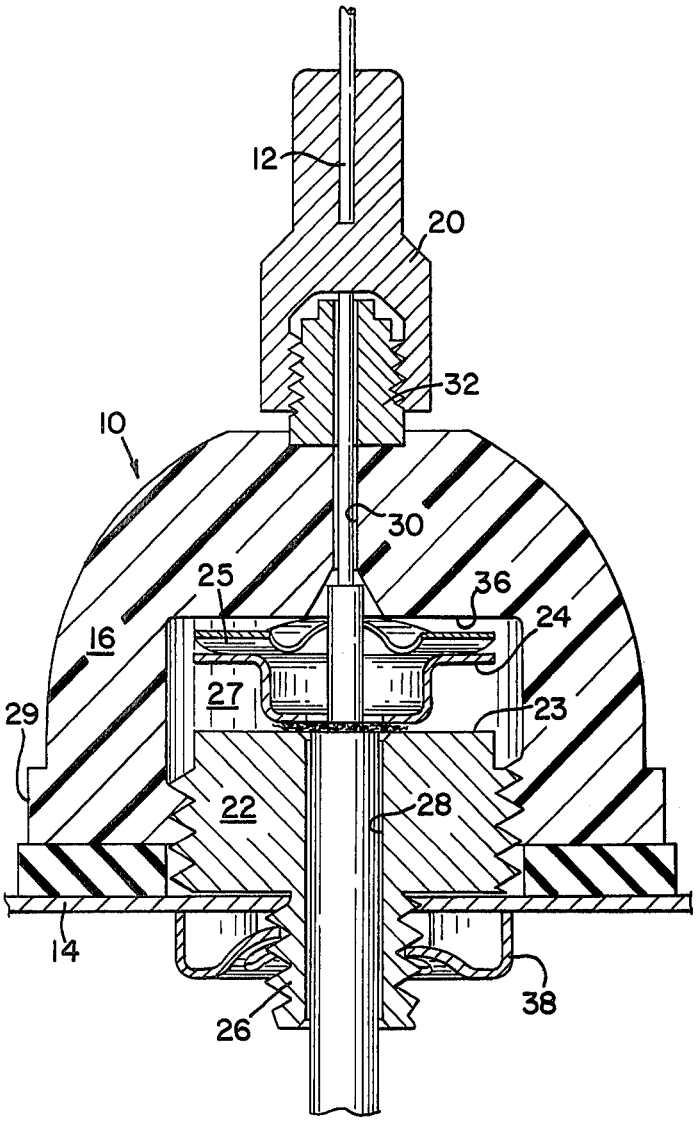
FIG. 3

ANTENNA MOUNTING BASE

BACKGROUND OF THE INVENTION

The present invention relates generally to antenna mounting structures and, more particularly, to an improved base for mounting a mobile antenna on a support plate and for connecting the antenna to a coaxial cable.

A wide variety of antenna mounting structures have been developed for use with mobile radios and citizen band equipment. These structures find their greatest application in mounting mobile antennas to the sheet metal exteriors of automobiles, trucks, and other vehicles. Typical examples of prior art mounting structures are illustrated in U.S. Pat. Nos. 2,476,407; 2,513,116 and 3,123,665. While some of these prior art mounting devices have met with considerable commercial success, they all nevertheless suffer from a number of disadvantages which have limited their acceptance and use. For example, the structures heretofore proposed have a relatively complex construction requiring the use of a large number of parts. They are, therefore, not only expensive to manufacture, but they are also expensive to install since they require substantial installation time. In addition, the field reliability and performance of the prior art structures is less than satisfactory, due to their complex construction and the fact that they are frequently assembled and installed by individuals having little or no experience with the installation procedure.

Another problem commonly associated with prior art structures is the failure of the electrical connection between the outer conductor of the coaxial cable and the grounding plane. This failure occurs primarily in those prior art structures wherein the outer conductor of the cable is clamped between a stationary member and a cap which threadedly engages the base member. Therefore, as the cap is threaded onto the base member the fragile strands of the outer conductor are drawn and may easily break off entirely.

SUMMARY OF THE INVENTION

Accordingly, the present invention is directed to a base for mounting an antenna to a thin, rigid surface or support plate wherein the problems associated with the prior art mounting structures are overcome. The present invention is directed to an antenna mounting base having a few individual components which may be expeditiously assembled and installed even by those with little or no installation experience. Because of its relatively simple construction, the cost of manufacturing the antenna base of the present invention is substantially reduced and its reliability and performance in the field are enhanced. Moreover, the means employed in the present invention for connecting the outer conductor of the coaxial cable to the grounding plane is constructed in such a manner as to minimize or eliminate entirely the poor electrical and mechanical connections sometimes associated with prior art devices.

The antenna mounting base of the present invention generally comprises an electrically conductive mounting nut, a dielectric cap, and a clamping member interposed between the mounting nut and cap. The mounting nut includes means for securing the assembly to a support plate and a longitudinally extending bore to receive a coaxial cable. The dielectric cap is configured to receive and house the mounting nut and includes a longitudinally extending bore, through which the central conductor of the coaxial cable extends, and means to electrically connect the central conductor to the antenna. The clamping element interposed between the mounting nut and cap is constructed in such a manner that the frictional engagement between the clamping element and the cap is less than the frictional engagement between the clamping element and the mounting nut with the outer conductor of the coaxial cable therebetween. In accordance with a preferred embodiment of the invention the clamping element includes a compressible member which not only compensates for tolerance variations between the individual components of the base but also helps to avoid the development of excessive clamping forces on the outer conductor of the coaxial cable.

BRIEF DESCRIPTION OF THE DRAWINGS

The novel features believed to be characteristic of the invention are set forth with particularity in the appended claims. The invention itself, however, together with further objects and attendant advantages, will be best understood by reference to the following detailed description taken in connection with the accompanying drawings, in which:

FIG. 1 is a perspective view illustrating the antenna base of the present invention in the final assembled position, mounting an antenna to a support plate;

FIG. 2 is an exploded perspective view illustrating the individual components of one preferred embodiment of the invention;

FIG. 3 is an enlarged cross-sectional view illustrating the preferred embodiment of FIG. 2 as finally assembled;

DETAILED DESCRIPTION OF THE INVENTION

Figure 4:
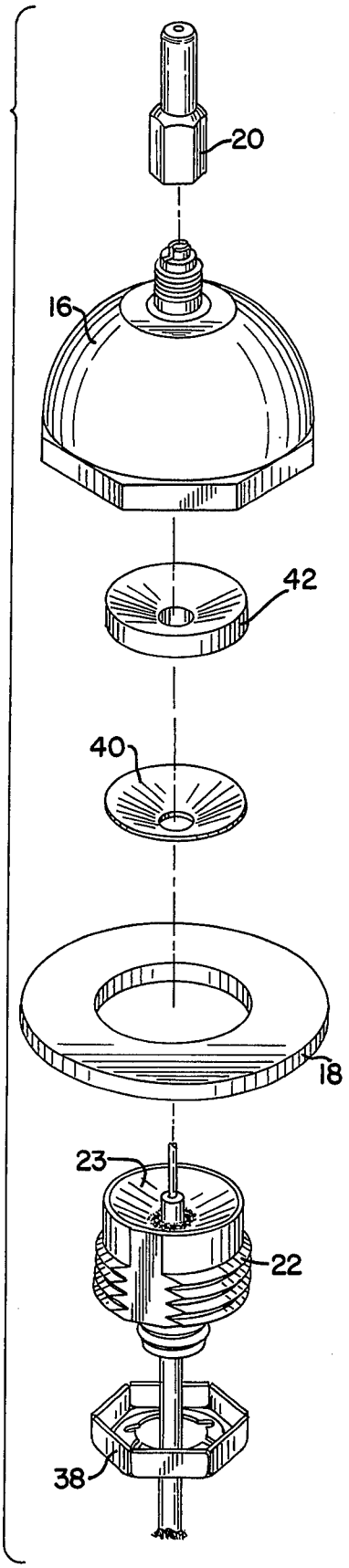
FIG. 4 is an exploded perspective view illustrating the individual components of another preferred embodiment of of the present invention.

Referring now to the drawings, and particularly FIG. 1, a mounting structure or base 10 is illustrated for supporting a mobile antenna 12 on a thin rigid support plate 14. The base 10 includes a cap 16 and an annular gasket 18 which seals the internal components of the base 10 from the environment. Means are also provided at the apex of cap 16 for supporting and engaging base nut 20 from which the antenna 12 extends. The base 10 also includes means described in detail below for electrically connecting a coaxial cable to the antenna; the cable being entirely conventional and including central and outer conductors separated by a dielectric and covered by an external sheath of insulation.

A preferred embodiment of the present invention is illustrated in FIGS. 2 and 3. In accordance with this embodiment, the base assembly includes cap 16, a mounting nut 22, and a clamping element including clamping washer 24 and wave spring 25. The mounting nut 22 is preferably externally threaded and includes means associated with one end for fastening or securing the assembly to support plate 14. The securing means illustrated in FIG. 3 comprises an externally threaded nipple 26 which engages an appropriately sized aperture in plate 14. The mounting nut 22 is formed from an electrically conductive material to provide a direct ground path between the outer conductor of the coaxial cable and the support plate 14 which also serves as a grounding plane for the antenna 12. The cap 16 is constructed from a dielectric material and includes a cavity 27 to receive and house the mounting nut 22. An internally threaded cap nut 29 is formed integrally with the base of the cap 16 to positively engage and secure the cap 16 to mounting nut 22. The cap 16 also includes means for connecting the antenna 12 to the base 10 such as metal insert 32 which may be conveniently formed as an integral part of the cap through conventional injection molding techniques. Both the mounting nut 22 and cap 16 include longitudinally extending central bores, 28 and 30 respectively, the bore 28 sized to receive a coaxial cable and bore 30 sized to receive the central conductor of the cable. The antenna whip nut 20 and insert 32 together comprise means for electrically connecting the central conductor of the coaxial cable to the antenna 12.

Interposed between the cap 16 and the mounting nut 22 is a clamping element which mechanically secures and electrically connects the outer conductor of the coaxial cable to the base 10. In accordance with the present invention, the clamping element is constructed such that the frictional engagement between the clamping element and the cap 16 is less than the frictional engagement between the clamping element and the upper surface 23 of mounting nut 22 with the outer conductor of the coaxial cable disposed therebetween. The clamping element illustrated in FIG. 3 includes clamping washer 24 and a member, such as wave spring 25, which is axially compressible with respect to the axis of the central conductor of the coaxial cable extending therethrough. The wave spring 25 obviates the tolerancing problems which would otherwise occur and assures that appropriate clamping forces are developed between the clamping washer 24 and mounting nut 22. It will be appreciated that the contact area of the wave spring 25 with the bearing surface 36 of cap 16 is relatively small compared with that of clamping washer 24 and surface 23 of mounting nut 22. Accordingly, as cap 16 is threaded onto nut 22 and clamping washer 24 begins to clamp the outer conductor to surface 23, the clamping washer 24 will remain generally stationary with respect to mounting nut 22. The individual strands of the outer conductor will therefore not be drawn or pulled since they are clamped between relatively stationary surfaces.

Where the underside of support plate 14 is accessible, a lock nut 38 may be utilized to more positively secure the base 10, although such additional securement means is unnecessary where the aperture in support plate 14 has been properly sized.

Figure 5:
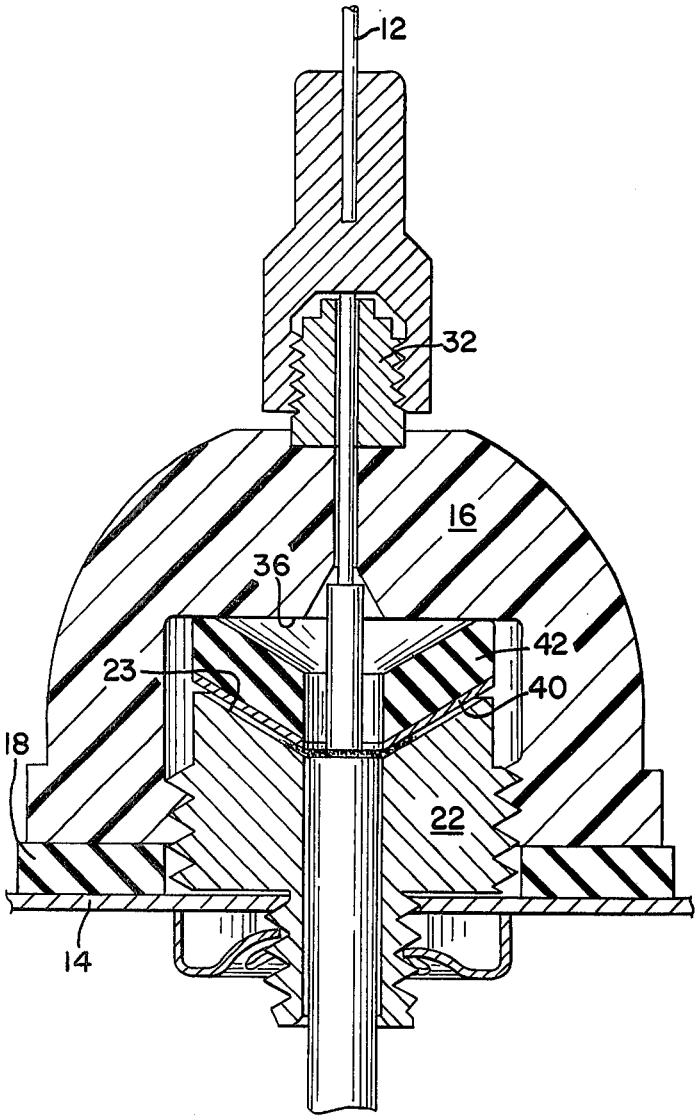
FIG. 5 is an enlarged cross-sectional view illustrating the preferred embodiment of FIG. 4 as finally assembled.

FIGS. 4 and 5 illustrate another preferred embodiment of the present invention which differs from the embodiment illustrated in FIGS. 2 and 3 only in the form of the clamping element employed and in the configuration of the upper surface of mounting nut 22. In accordance with this embodiment of the invention, the clamping element includes a clamping washer 40 and a resilient washer 42. While the clamping element illustrated in FIG. 4 is shown to comprise separate washers 40 and 42, the clamping element may be integrally formed with the elastomer bonded to one side of clamping washer 40. As is most clearly seen in FIG. 5, the upper surface 23 of mounting nut 22 has an inwardly tapering configuration forming an inverted cone. The clamping element likewise has a generally frusto-conical configuration such that the clamping washer 40 mates with the surface 23 over a substantial portion of its area, whereas the resilient washer 42, forming a backing to washer 40, contacts the bearing surface 36 of cap 16 only at its periphery.

It is again apparent that the construction of the clamping element illustrated in FIGS. 4 and 5 is such that the frictional engagement between it and bearing surface 36 will be less than the frictional engagement between washer 40 and surface 23. Once again, therefore, as the cap 16 is threaded over mounting nut 22, the clamping element will remain generally stationary relative to mounting nut 22, thereby assuring a more suitable mechanical securement and electrical connection of the outer conductor of the coaxial cable with the mounting base 10. Since the washer 42 is axially compressible relative to the axis of the coaxial cable, the clamping element can accommodate any variations in tolerances which might otherwise adversely affect the development of suitable clamping forces between washer 40 and surface 23.

It will be appreciated that in both embodiments illustrated, the annular gasket 18 surrounds the mounting nut 22 and seals the internal components of the base 10 from the external environment. In addition, insert 32 may be constructed as a bifurcated or slotted sleeve which compresses to clamp the central conductor as whip nut 20 is threaded thereon. It is also desirable to chamfer the inside opening of bore 30 at surface 36, as shown, to facilitate the threading of the central conductor through the cap 16.

The construction and design of the present invention facilitates the assembly of the antenna base and the installation of the mobile antenna, and greatly enhances the quality of the mechanical and electrical connection obtained. The installation is simple and straightforward. After forming a properly sized aperture in the ground and support plate 14, the coaxial cable is threaded through the aperture and the insulation is stripped to expose an appropriate length of both the central and outer conductors. The mounting nut 22 is then threaded over the stripped end of the cable and secured to the plate 14 by screwing the nipple 26 in the plate aperture. The outer conductor is flared outwardly, after which the gasket 18 and the clamping element are threaded over the cable and properly aligned with the mounting nut 22. Next, the cap 16 is placed over the cable end and the central conductor is inserted into bore 30. As the cap 16 is threaded onto nut 22, the outer conductor is clamped against surface 23, and the gasket 18 seals the interface between the cap 16 and the support plate 14. The antenna 12 is finally mounted onto insert 32, the insert and whip nut 20 firmly connecting the central conductor to the antenna.

Of course, it will be apparent to those skilled in the art that various changes and modifications may be made to the preferred embodiments described herein without departing from the spirit and scope of the present invention and without loss of its attendant advantages. All such changes and modifications are, therefore, intended to fall within the scope of the appended claims.

I claim:

1. A base for mounting a mobile antenna on a support plate and for connecting said antenna to a coaxial cable, comprising:

an electrically conductive mounting nut including a longitudinally extending bore to receive a coaxial cable and means at one end thereof for securing said nut to a support plate;

a dielectric cap to receive and house said mounting nut and including a longitudinally extending bore to receive the central conductor of said coaxial cable;

means cooperating with said cap bore to electrically connect said central conductor to said antenna; and a clamping element interposed between said mounting nut and said cap to mechanically secure and electrically connect the outer conductor of said coaxial cable to said mounting nut, the frictional engagement between said clamping element and said cap being less than the frictional engagement between said clamping element and said mounting nut with the outer conductor therebetween.

2. The antenna base of claim 1 wherein said clamping element includes an axially compressible member.

3. The antenna base of claim 2 wherein said compressible member comprises an annular wave spring.

4. The antenna base of claim 2 wherein said compressible member comprises a resilient washer.

5. The antenna base of claim 1 wherein said clamping element comprises a cup-shaped washer and an annular wave spring.

6. The antenna base of claim 1 wherein said clamping element comprises a metal washer having a resilient elastomer bonded to one side thereof.

7. The antenna base of claim 1 wherein the other end of said mounting nut includes an inverted conical surface and said clamping element has a generally frustoconical configuration, whereby said clamping element mates with said mounting nut over a substantial portion of its area and contacts said cap only at its periphery.

8. The antenna base of claim 1 wherein said mounting nut securing means includes an externally threaded nipple extending from said one end to engage an aperture in said support plate.

9. The antenna base of claim 1 wherein said cap includes a metal insert through which said central conductor extends and said antenna includes a whip nut adapted to engage said insert, said whip nut and said insert together comprising said electrical connecting means.

10. The antenna base of claim 1 further including an annular seal surrounding said mounting nut and disposed between said cap nut and said support plate.

11. A base for mounting a mobile antenna on a support plate and for connecting said antenna to a coaxial cable, comprising:

an externally threaded and electrically conductive mounting nut including a longitudinally extending bore to receive a coaxial cable and means at one end thereof for securing said nut to a support plate;

a dielectric cap to receive and house said mounting nut including an internally threaded nut formed integral therewith and adapted to engage the external thread of said mounting nut and a longitudinally extending bore to receive the central conductor of said coaxial cable;

means cooperating with said cap bore to electrically connect said central conductor to said antenna;

an annular seal surrounding said mounting nut and disposed between said cap nut and said support plate; and a clamping element interposed between said mounting nut and said cap to mechanically secure and electrically connect the outer conductor of said coaxial cable to said mounting nut, the contact area between said clamping element and said cap being relatively small to minimize the frictional engagement therebetween and to maintain said clamping element substantially stationary relative to said mounting nut upon rotation of said cap thereon.

12. A base for mounting an antenna on a support plate and for connecting said antenna to a coaxial cable, comprising:

an electrically conductive mounting nut including a longitudinally extending bore to receive a coaxial cable and means at one end thereof for securing said nut to a support plate the other end of said nut providing a first outer conductor clamping surface;

a dielectric cap to receive and house said mounting nut including a longitudinally extending bore to receive the central conductor of said coaxial cable;

means cooperating with said cap bore to electrically connect said central conductor to said antenna; and a clamping element interposed between said mounting nut and said cap to mechanically secure and electrically connect the outer conductor of said coaxial cable to said mounting nut, said clamping element having one side providing a second outer conductor clamping surface, the coefficient of friction between said clamping element and said cap being less than the coefficient of friction between said first and second clamping surfaces with the outer conductor of said coaxial cable therebetween.

* * * * *